United States Patent [19]

Keck

[11] 4,075,986

[45] Feb. 28, 1978

[54] ROTARY-POPPET VALVE INTERNAL COMBUSTION ENGINE

[76] Inventor: Mark Keck, 60 Argonne, Belmont Shores, Calif. 90803

[21] Appl. No.: 704,169

[22] Filed: Jul. 12, 1976

[51] Int. Cl.[2] ..... F01L 1/28

[52] U.S. Cl. ..... 123/79 R; 123/190 R

[58] Field of Search ..... 123/79 R, 79 A, 80 R, 123/190 R, 190 BF

[56] References Cited

U.S. PATENT DOCUMENTS

| | | | |
|---|---|---|---|
| 1,311,200 | 7/1919 | Abell | 123/79 R |
| 1,374,158 | 4/1921 | Irshaw | 123/79 R |
| 1,443,110 | 1/1923 | Abell | 123/79 R |
| 1,599,530 | 9/1926 | Hogan | 123/79 R |
| 1,629,795 | 5/1927 | Jobes | 123/79 R |
| 1,951,759 | 3/1934 | Keister | 123/79 R |
| 2,107,389 | 2/1938 | Price et al. | 123/79 R |
| 2,392,060 | 1/1946 | Osborn | 123/79 R |
| 3,089,506 | 4/1963 | Dobrosavljeuic | 123/79 R |

*Primary Examiner*—Charles J. Myhre
*Assistant Examiner*—David D. Reynolds
*Attorney, Agent, or Firm*—William H. Maxwell

[57] ABSTRACT

An internal combustion engine of the four cycle reciprocating piston type wherein intake and exhaust of working fluid and combustible fuel into the engine cylinder is controlled by poppet valve means, while induction air is diverted by rotary valve means between intake and exhaust, said valve means being operated in timed relation with respect to each other at half crank shaft speed of rotation, utilizing blower induction of air as the working fluid which is diverted between intake and exhaust, and advantageously employing fuel injection through a valve plenum that is ported and through which the working fluid is controlled by the cooperatively timed rotary and poppet valve means.

17 Claims, 10 Drawing Figures

INTAKE - INJECTION

COMPRESSION - SCAVENGE

POWER – IGNITION – SCAVENGE

EXHAUST

ROTARY-POPPET VALVE INTERNAL COMBUSTION ENGINE

BACKGROUND

This invention relates to internal combustion engines of the four cycle reciprocating type wherein a first down-stroke of a piston effects intake of working fluid following the preceding exhaust, followed by a first up-stroke of the piston that effects compression of said working fluid, followed by a second down-stroke of the piston as a result of combustion and expansion of the working fluid, and finally followed by a second up-stroke of the piston that effects exhaust and expending of said working fluid. Valves are usually employed to operate in timed relation to a crank shaft connected to the piston by connecting rods journaled thereto respectively, for example poppet or rotary or sleeve type valves, exclusively and not a combination of these known types of valves. There are of course, various advantages and disadvantages with these different types of valves, the poppet type being most widely used and highly developed and operated by cams driven in timed relation to the crank shaft. However, rotary valves have not been too successful where hot gases are concerned, but they have advantages in directing fluid selectively via a multiplicity of ports. It is a general object of this invention to combine the advantageous features of the poppet valve and rotary valve so that they are cooperative in providing unobvious results. With this invention, both the intake and exhaust of the working fluid are blown and the fuel is injected, and all to the end that there is supercharged induction and the after burning of exhaust. It will be seen therefore, that this engine has both the advantage of blown intake and exhaust.

The conventional engine requires separate poppet valves for intake and exhaust, operated in timed relation to rotation of the engine crank shaft so that the intake valve opens only on the first mentioned down-stroke and so that the exhaust valve opens only on the last mentioned up-stroke. It is an object of this invention to advantageously handle both intake and exhaust with a single poppet valve, utilizing the sequence of the exhaust being followed by the intake, characteristic of four cycle engines. With the present invention, a single poppet valve is opened for exhaust and remains open for intake, all of which is made possible by combining therewith a rotary valve that controls intake and/or diverts blown air between induction and exhaust. During the intake down-stroke, the rotary valve directs blown air through the opened poppet valve, after which the rotary valve diverts blown air into the exhaust when the poppet valve is closed during the compression stroke. The poppet valve remains closed throughout the compression and power strokes during which the rotary valve remains open from induction into the exhaust. During the exhaust up-stroke the rotary valve closes off the blown air to both intake and exhaust while diverting the exhaust from the opened poppet valve. As with conventional engines, the valve timing of this invention is at one half crank shaft speed, it being understood that opening and closing of said poppet valve is related to the top dead center and bottom dead center positions of the crank shaft as with conventional engines of the reciprocating piston type.

It is imparitive for compression of working fluids that the valves close tightly, and it is for this reason that poppet valves have been so widely used for this purpose. In practice, there is no problem in seating poppet valves tightly. However, with rotary valves sealing is a problem as sliding fits are involved. To the contrary sealing is not a problem with this invention, since the subject rotary valve is employed for diverting blown air used advantageously for both intake and exhaust. Accordingly, it is an object of this invention to cooperatively employ the seating advantages of the poppet valve with the diverting advantages of the rotary valve, in an engine wherein the working fluids are induced by blower means.

Heretofore, the use of air pumps and blowers have been relegated to either that of supercharging or exhaust scavenging, and in both by means of a single pump or blower. That is, both induction and exhaust blowers have been widely used for their respective advantages, but not as a single blower adapted by valve means to serve both purposes of supercharging and scavenging. To this end therefore, it is an object of this invention to provide valve means that diverts blower air between the engine intake and exhaust. With the rotary valve hereinafter described, the conventional intake and exhaust poppet valves (two valves) can be employed; or preferably as shown, a single dual purpose poppet valve is employed for both intake and exhaust.

Feasibility of carburetion is an object of the present invention, although not the preferred form thereof. In the event that carburetion is desired, the rotary valve is made of the duplex or double type with separated channels diverting the intake and exhaust and to the end that carburetion induction air enters the poppet valve plenum and cylinder without contacting the exhaust, and the exhaust passing through said plenum without contacting the intake; all of which is made possible by the diverting capabilities of the rotary diverter valve operating in cooperatively timed relationship with the cylinder controlling poppet valve.

Fuel injection has qualities superior to carburetion, and with this engine operated to share blower induction with blower scavenging, said fuel injection or the equivalent is preferred. It would be obviously prohibitive to blow the exhaust with carbureted air, when after burning of the exhaust combustibles is desired. Therefore, it is an object of the preferred form of this invention to fuel inject in combination with a rotary diverter valve and cylinder controlling poppet valve. It is characteristic of this invention that the poppet valve controls the cylinder intake, compression and exhaust, while the rotary valve diverts blower air between intake and exhaust; and all of which requires timed injection of fuel during the intake stroke or cycle of engine operation. As will be described, the valve relationships are conducive to fuel injection without any adverse effect upon the sharing of the air induction with exhaust scavenging.

It is an object of this invention to provide a compatible arrangement of dissimilar rotary and poppet valves, in an internal combustion engine of the four cycle type. Conventional valve gear involves cam shaft operated tappets or lifters, conducive to poppet valve operation; while rotary valves involve gearing or the like. With the present invention the timed sequence of rotary and poppet valve operation are both compatible with four cycle operation, and both operated at one half engine speed of rotation. As will be described with respect to the several embodiments of this invention, these two dissimilar but cooperatively related valves are driven together or one from the other, as by gears or chains or belts and/or the poppet valve by means of tappets or rockers; all of which are directly driven from the engine crank shaft. Further, the valve gear combination as hereinafter disclosed is adaptable to multicylinder engines with a single induction blower and manifold characteristically coordinated with a single exhaust after burner manifold.

SUMMARY OF THE INVENTION

The rotary-poppet valve engine of the present invention involves the four cycle principle of operation which requires intake, compression, power and exhaust strokes that follow sequentially as stated. Intake and exhaust of air and combustible fuel into the engine cylinder is controlled by one or more poppet valves and preferably a single poppet valve, while air from a blower is diverted by a rotary valve between intake and exhaust. Characteristically, the rotary and poppet valves are operated in timed relation to each other at one half crank shaft speed, the rotary valve being open to the poppet valve during the intake stroke, and open to the exhaust during the compression and power strokes. Further and an unobvious feature is the closing off of the blower air during the exhaust stroke; closed to both intake and exhaust. The poppet valve or valves characteristically open the cylinder during the exhaust and intake strokes and close the cylinder during the compression and power strokes. Induction air to the rotary valve is supplied by a blower and the combustible fuel is injected into the cylinder during the intake stroke and preferably at or ahead of the rotary valve. The valve opening and closing overlaps (timing) can vary as circumstances require according to the performance required for breathing of the engine. That is, the opening and/or closing of the rotary or poppet valves can precede and follow dead center positions of the crank shaft as heretofore practiced in this art; the opening and closing positions being indicated herein as occuring substantially on the said dead center positions although it is to be understood that ultimate engine design will dictate requirements in this respect.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
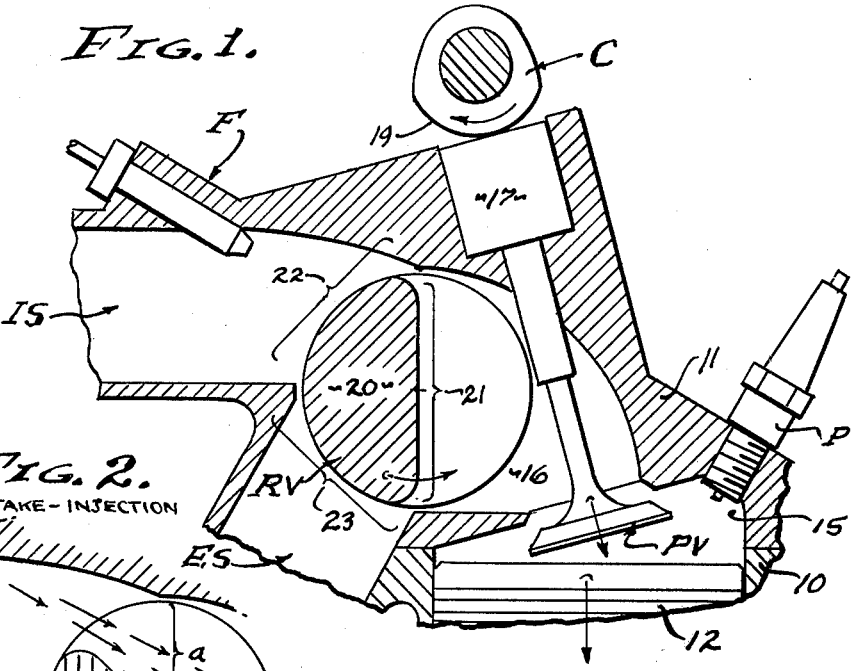
FIG. 1 is a cross sectional view of the essential engine components, showing the position thereof at the commencement of the intake stroke.
Figure 2:
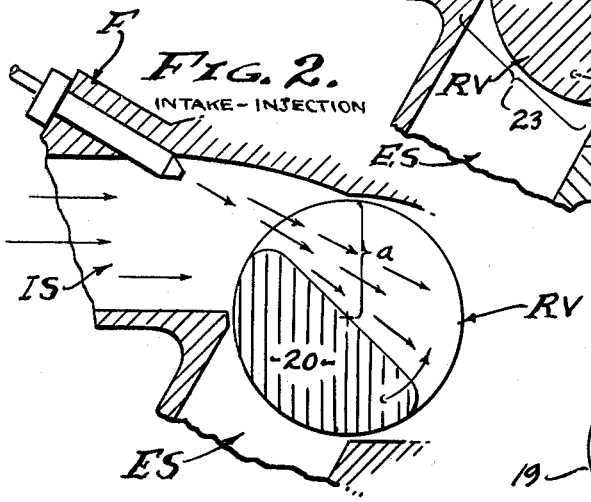
FIG. 2 is a fragmentary view showing the rotary and poppet valve positions during the intake stroke that follows the positioning of elements shown in FIG. 1.
Figure 3:
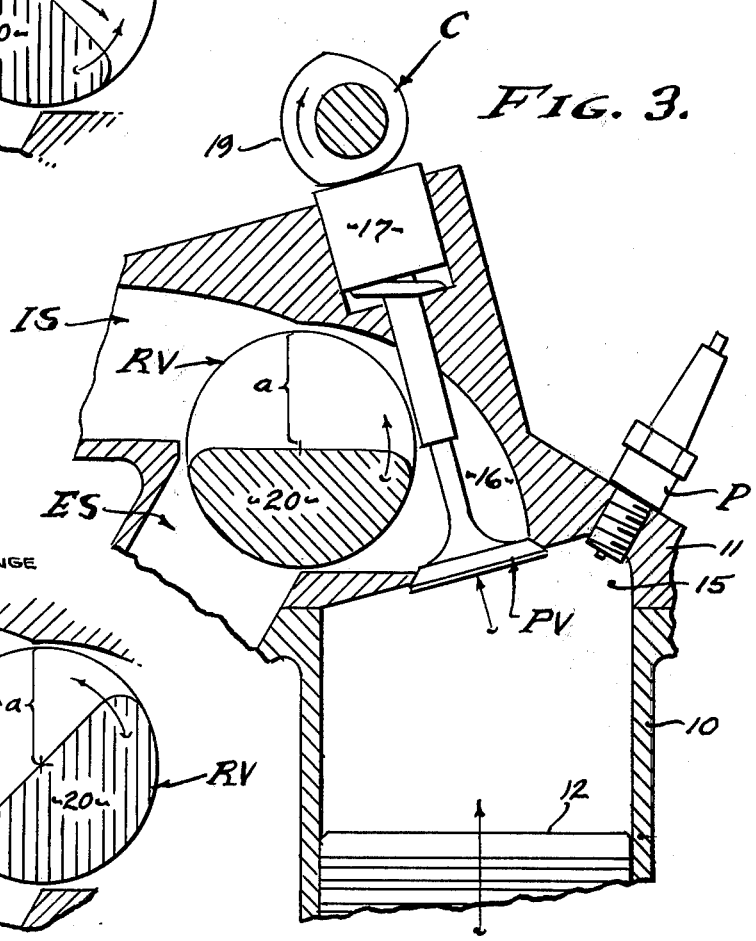
FIG. 3 is a view similar to FIG. 1 showing the position of elements at the commencement of the compression stroke.
Figure 4:
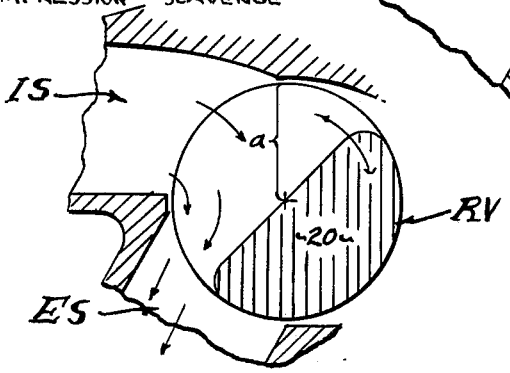
FIG. 4 is a fragmentary view showing the rotary and poppet valve positions during the compression stroke that follows the positioning of elements shown in FIG. 3.

Referring now to the drawings, the basic internal combustion engine involves generally a cylinder 10 closed by a head 11 and in which a piston 12 reciprocates between top and bottom dead center positions of a crank shaft 13 to which it is coupled by a connecting rod 14. The engine frame and crank case structure (not shown) is conventional. However, the head structure is unique with this invention as it incorporates the novel combination of poppet and rotary valves PV and RV therein, and cooperatively related induction and exhaust stacks IS and ES with a blower means B and fuel injection means F. Included is drive means D for the rotary and poppet valves, and for the blower and injection means operated in timed relation therewith.

Referring now to the head 11, whether liquid or air cooled (not shown), there is a combustion chamber 15 at or above the plane of joinder with the engine frame, as with conventional engines. The said chamber is opened and closed to a valve plenum 16 by means of one or more poppet valves PV, the induction and exhaust being controlled to flow through said plenum by means of the rotary valve RV. It is to be understood that the handling of intake and exhaust can be separated if so desired, however a reduction of valve parts is to be realized by employing a single poppet valve PV and a single rotary valve RV disclosed herein as the preferred form of this invention. It is also to be understood that use of this valve combination can be restricted to either blown induction or blown exhaust, although it is preferred that the advantages of both be employed as will now be described.

This invention is shown in its adaptation to a four cycle internal combustion engine, Otto Cycle or Diesel Cycle; and preferably the former in which case fuel is injected into or through the induction stack IS, with a conventional spark plug P for ignition (electrical distribution not shown). From FIGS. 1 through 8 of the drawings it will be apparent that the engine is of the conventional four cycle type, the poppet valve PV being opened throughout exhaust and intake strokes by means of a cam C, and permitted to close thereby throughout the compression and power strokes. In accordance with this invention the poppet valve PV opens and closes the combustion chamber to the plenum 16, while the rotary valve RV selectively opens and closes the induction stack IS and exhaust stack ES to the plenum 16. Accordingly, the said plenum 16 extends between the valves PV and RV, the former to govern intake and exhaust to and from the cylinder 10, and the latter to divert blower induction air between said plenum 16 and the exhaust stack ES. As shown, the poppet valve PV is conventional in every respect, with a spring biased tappet 17 depressed by means of cam C. Note the circumferentially extended cam lobe 19 that depresses the poppet valve PV throughout the exhaust and intake strokes of the engine.

Figure 5:
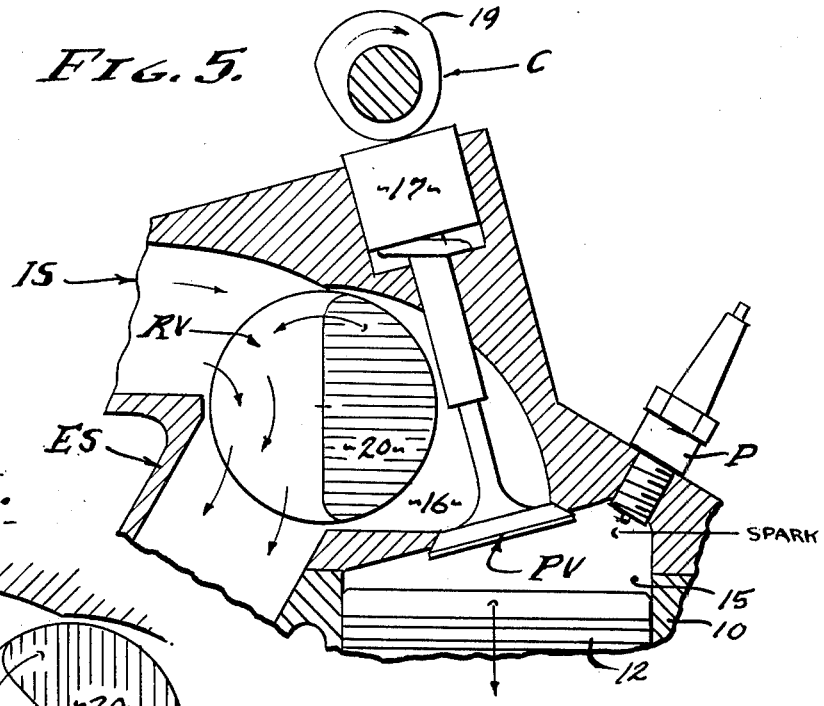
FIG. 5 is a view similar to FIGS. 1 and 3 showing the position of elements at the commencement of the power stroke.
Figure 6:
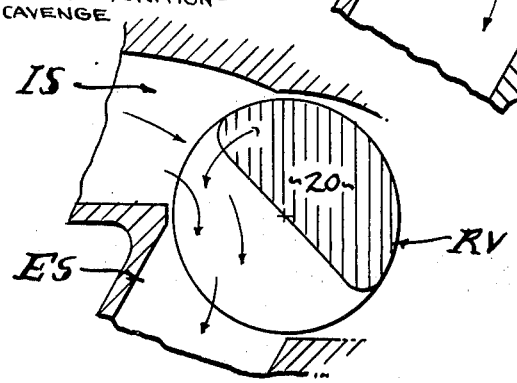
FIG. 6 is a fragmentary view showing the rotary and poppet valve positions during the power stroke that follows the positioning of elements shown in FIG. 5.
Figure 7:
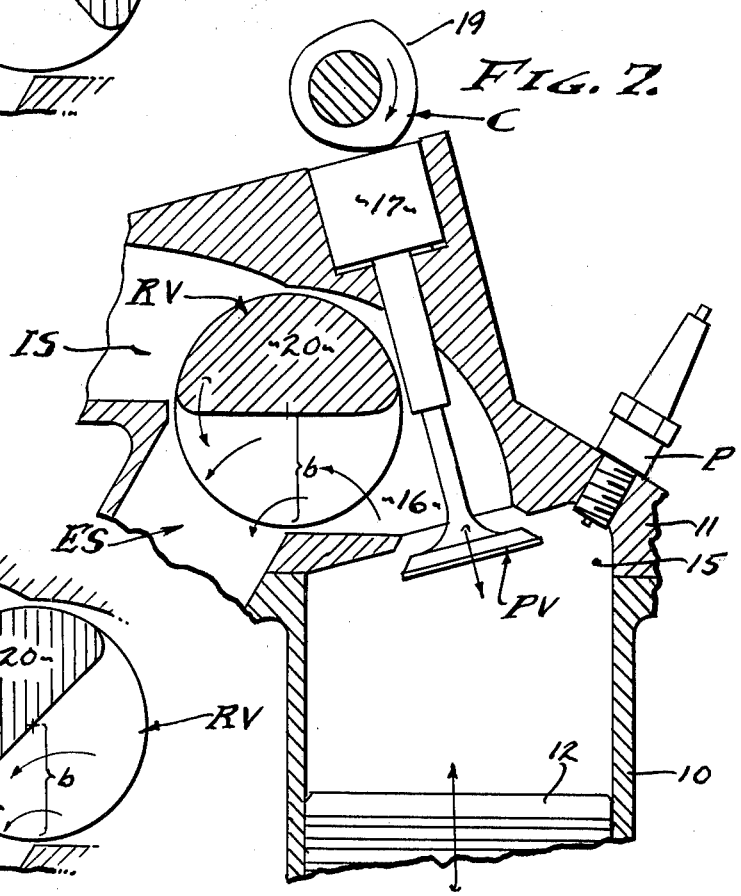
FIG. 7 is a view similar to FIGS. 1, 3, and 5 showing the position of elements at the commencement of the exhaust stroke.
Figure 8:
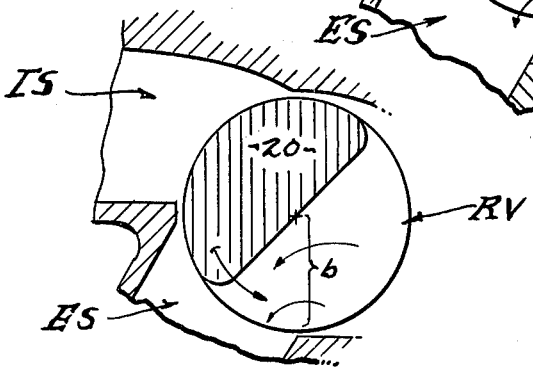
FIG. 8 is a fragmentary view showing the rotary and poppet valve positions during the exhaust stroke that follows the positioning of elements shown in FIG. 7.

The rotary valve RV is a three-way valve means, which in the broad sense can be any means to divert induction air from the plenum 16 during exhaust and into said plenum 16 during intake. In its preferred rotary form, the valve RV is a truncated cylinder 20 disposed on an axis of rotation spaced and parallel to the crank shaft axis and diametrically occupying a port 21 opening into the plenum 16. As shown, the truncated cylinder presents a semicircular solid that closes the port 21 totally only when positioned as shown in FIG. 5, which opens the upper intake portion *a* of port 21 when revolving through the positions shown in FIGS. 1 to 4; and which opens the lower exhaust portion *b* of said port 21 when revolving through the positions shown in FIGS. 7 and 8. Further with respect to the induction stack IS and exhaust stack ES, the truncated valve cylinder 20 closes the induction stack IS to said plenum through the positions shown in FIGS. 5 to 8, while opening the induction stack IS to the exhaust stack ES through the positions shown in FIGS. 3 to 6. It is a feature of this invention that the rotary valve RV revolves (counterclockwise as shown) sequentially to close port 21 of the plenum 16, a port 22 of the induction stack IS and a port 23 of the exhaust stack ES. In practice, the port 21 encompasses 180° while the ports 22 and 23 encompass 90° respectively. (see FIG. 1)

The blower means B can be any suitable air pump, such as an axial or centrifugal (or combination thereof) fan as indicated, the pressured discharge thereof being directed through the induction stack IS to the port 22. Following the port 22 in the direction of valve rotation, is the port 23 opening into the exhaust stack ES. Therefore, the truncated half cylinder of the rotary valve RV sequentially closes ports 22 and 23; so that the induction stack IS is closed when the port 23 is open through the exhaust portion *b* of port 21 and into the cylinder 10 through the opened poppet valve PV (see FIGS. 7 and 8); and so that the exhaust stack ES is closed when the port 22 is open through the intake portion *a* of port 21 and into the cylinder 10 through the opened poppet valve PV (see FIGS. 1 and 2); thereby accommodating the exhaust and intake cycles of the engine. Subsequent to the foregoing, the truncated half cylinder of rotary valve RV opens through port 23 to the exhaust stack ES throughout both the compression and power stroke of the engine, during which the poppet valve PV is closed and plenum 16 has no function (see FIGS. 3–6), whereby the exhaust is blown with air to support after burning as may be required.

Figure 9:
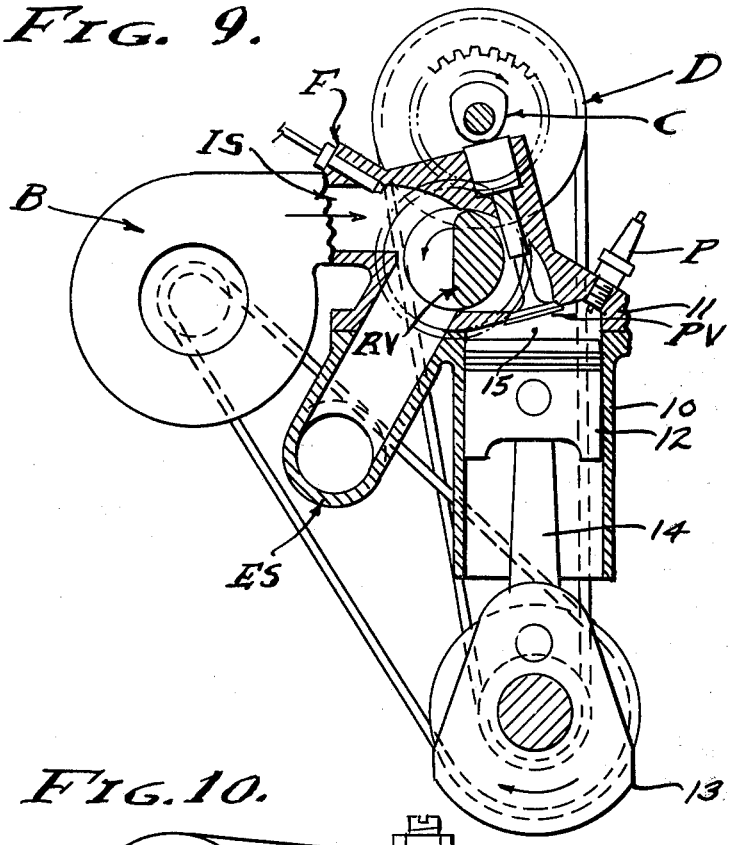
FIG. 9 is a fragmentary cross sectional view of an engine embodying the present invention.

As shown in FIG. 9, the valve timing is by the drive means D whereby the two valves RV and PV operate at one half the speed or rotational rate of crank shaft 13. In practice, a transmission in the form of gears, belts or chains, or any combination thereof, rotate the valve RV and cam C at one half crank shaft speed; and the blower B at a suitable higher rate of speed. For example, the cam C is driven by chain or cog-belt at half speed to turn clockwise with rotation of the crank shaft 13, while the rotary valve RV is driven by direct gear engagement to turn counterclockwise at said half speed. The blower B can be driven by an exhaust turbine or the like, or by a belt drive from the crank shaft as shown.

The fuel injection means F is of conventional type involving distributor means (not shown) that atomizes fuel into the induction stack and/or plenum 16 during the intake stroke of the engine. Consequently, with the rotating valve hereinabove described blower air is utilized for both induction and exhaust, the combustible fuel mixture being established with blower air only and during the intake stroke.

Figure 10:
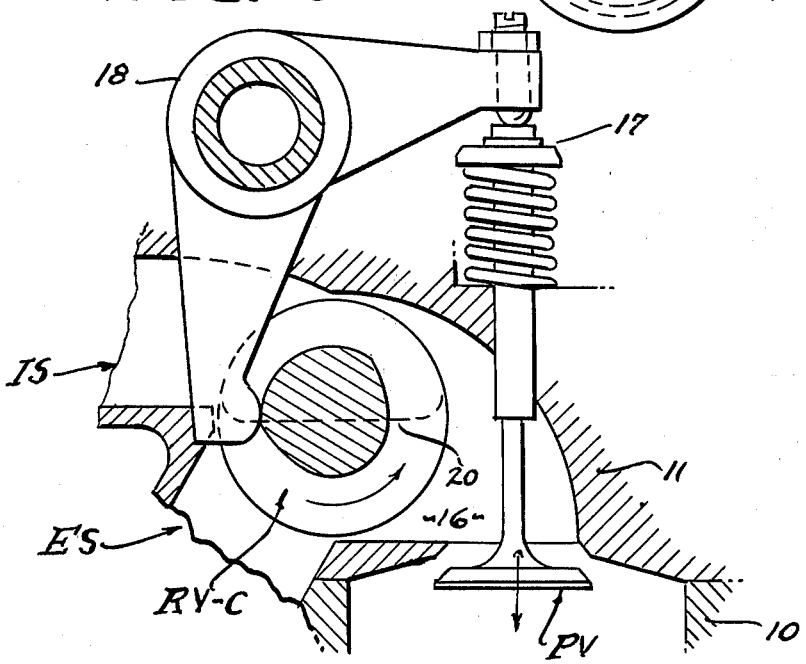
FIG. 10 is a view similar to FIG. 7 and shows a second form of valve gear.

Referring now to FIG. 10 of the drawings, it is feasible to combine the rotating valve and cam shaft as a cam and valve shaft RV-C, revolving counterclockwise as shown by means of a half speed gear transmission. The tappet 17 is depressed by a rocker 18 arranged in the usual manner with a return spring and adjustment.

From the foregoing, it will be seen that I have provided a rotary-poppet valve engine that advantageously utilizes blower air to charge the cylinder and alternately to after-burn the exhaust. A single intake valve is then feasible, of larger diameter for increased breathing ability, and of dual purpose functioning for both intake and exhaust; the cooling effect of the fuel injection during intake reducing valve temperature with respect to the exhaust function of said poppet valve, while the rotary valve revolves within the port 21 and isolated from the combustion chamber of the cylinder to divert blower air alternately from port 22 to the ports 23 and 21*a* respectively, and to divert exhaust from plenum 16 to the exhaust stack ES via ports 21*b* and 23.

Having described only typical preferred forms and applications of my invention, I do not wish to be limited or restricted to the specific details herein set forth, but wish to reserve to myself any modifications or variations that may appear to those skilled in the art:

I claim:

1. A four stroke internal combustion reciprocating piston and cylinder engine including; induction and exhaust stacks, blower means supplying air to said induction stack, a first valve means opening into the cylinder and controlling intake, compression, power and exhaust strokes thereof, and a second valve means opening sequentially (1) to divert induction air into the cylinder through said first valve means during the intake stroke, (2) to divert induction air into the exhaust stack during the compression and power strokes, and (3) to divert exhaust gases from cylinder and through said first valve means into the exhaust stack during the exhaust stroke, there being means for timing the said first and second valve means and for timed induction of fuel during the power stroke.

2. The internal combustion engine as set forth in claim 1, wherein the first mentioned valve means is of the poppet type.

3. The internal combustion engine as set forth in claim 1, wherein the second mentioned valve means is of the rotary type.

4. The internal combustion engine as set forth in claim 1, wherein the second valve means sequentially opens adjacent ports, (1) a port from the induction stack, (2) a port to the exhaust stack, and (3) a port to the first mentioned valve means.

5. The internal combustion engine as set forth in claim 1, wherein the second valve means comprises a rotatable diametrically truncated cylinder that sequentially opens circumferentially adjacent ports, (1) a port from the induction stack, (2) a port to the exhaust stack, and (3) a port to the first mentioned valve means.

6. The internal combustion engine as set forth in claim 1, wherein the second valve means comprises a rotatable diametrically truncated cylinder that sequentially opens circumferentially adjacent ports, (1) a port from the induction stack, (2) a port to the said exhaust stack and opened to the port from the induction stack during the compression and power strokes, and (3) a port to and from said first mentioned valve means and opened to the port to said exhaust stack during the said exhaust stroke and opened to the port from said induction stack during the intake stroke.

7. The internal combustion engine as set forth in claim 1, wherein the second mentioned valve means diverts induction air between intake and exhaust from blower means.

8. The internal combustion engine as set forth in claim 1, wherein blower means supplies induction air diverted through said second valve means, wherein the first mentioned valve means comprises a single poppet valve with means to open the cylinder throughout the exhaust and intake strokes and to close the same throughout the compression and power strokes, and wherein the second valve means comprises a rotatable diametrically truncated cylinder that sequentially opens circumferentially adjacent ports, (1) a port of substantially 90° arc from said blower means through the induction stack, (2) a port of substantially 90° arc to the exhaust stack and opened to the port from the induction stack and from said blower means during the compression and power strokes, and (3) a port of substantially 180° arc to and from said first mentioned valve means and opened to the port to said exhaust stack during the exhaust stroke and opened to the port from said induction stack and from the blower means during the intake stroke.

9. A four stroke internal combustion engine of the reciprocating piston and cylinder type, and including; a head having a valve plenum with adjacent induction and exhaust stacks at one side thereof, blower means supplying air to said induction stack, a first valve means opening from the other side of the plenum and into the cylinder, and a second valve means operating within a port defined by the plenum to extend between said induction and exhaust stacks and controlling said plenum stacks to divert working fluid sequentially (1) from the induction stack and through said first valve means and into the said cylinder during the intake stroke, (2) from the induction stack to the exhaust stack during the compression and power strokes, and (3) from the said cylinder and through said first valve means to the exhaust stack during the exhaust stroke, there being means for timing the said first and second valve means and for timed induction of fuel for the power stroke.

10. The internal combustion engine as set forth in claim 9, wherein the first mentioned valve means is of the poppet type.

11. The internal combustion engine as set forth in claim 9, wherein the second mentioned valve means is of the rotary type with the plenum port juxtaposed thereto.

12. The internal combustion engine as set forth in claim 9, wherein the second mentioned valve means comprises a diametrically truncated cylinder rotatable adjacent said induction and exhaust stacks and arcuately juxtaposed to said stacks at one side of the plenum and rotatable within the said port defined by the plenum and diametrically juxtaposed thereto.

13. The internal combustion engine as set forth in claim 9, wherein blower means induces air through the said induction stack, and wherein the second mentioned valve means comprises a diametrically truncated cylinder rotatable adjacent said induction and exhaust stacks and arcuately juxtaposed to said stacks at one side of the plenum and rotatable within the said port defined by the plenum and diametrically juxtaposed thereto to divert induction air from blower means from said induction stack and sequentially to the first mentioned valve means and the exhaust stack respectively.

14. The internal combustion engine as set forth in claim 1, wherein the last mentioned means injects fuel through the first mentioned valve means during the intake stroke.

15. The internal combustion engine as set forth in claim 1, wherein the last mentioned means injects fuel through the first and second mentioned valve means during the intake stroke.

16. The internal combustion engine as set forth in claim 9, wherein the last mentioned means injects fuel through the first mentioned valve means during the intake stroke.

17. The internal combustion engine as set forth in claim 9, wherein the last mentioned means injects fuel through the first and second mentioned valve means during the intake stroke.

* * * * *